US011523715B2

(12) United States Patent
Racioppi et al.

(10) Patent No.: US 11,523,715 B2
(45) Date of Patent: Dec. 13, 2022

(54) TOUCHLESS SANITIZER COMBINATION DEVICE

(71) Applicant: RAC-STA, LLC, Ocean Township, NJ (US)

(72) Inventors: Heather Racioppi, Ocean Township, NJ (US); Gina Stavola, Ocala, FL (US)

(73) Assignee: RAC-STA, LLC, Ocean Township, NJ (US)

( * ) Notice: Subject to any disclaimer, the term of this patent is extended or adjusted under 35 U.S.C. 154(b) by 129 days.

(21) Appl. No.: 17/233,827

(22) Filed: Apr. 19, 2021

(65) Prior Publication Data

US 2021/0361125 A1 Nov. 25, 2021

Related U.S. Application Data

(60) Provisional application No. 63/101,877, filed on May 20, 2020.

(51) Int. Cl.
*A47K 5/12* (2006.01)
*A47K 17/00* (2006.01)

(52) U.S. Cl.
CPC ..... *A47K 5/1217* (2013.01); *A47K 17/00* (2013.01)

(58) Field of Classification Search
CPC .. A47K 5/1217; A47K 5/1202; A47K 10/421; A47K 10/46; A47K 17/00
USPC ..... 222/52, 1, 129, 173
See application file for complete search history.

(56) References Cited

U.S. PATENT DOCUMENTS

| | | | | |
|---|---|---|---|---|
| 3,221,928 | A | 12/1965 | Horn | |
| 3,425,595 | A | 2/1969 | Shapira | |
| 3,592,161 | A | 7/1971 | Hoffmann | |
| 3,865,271 | A * | 2/1975 | Gold | A47K 10/32 221/96 |
| 4,620,502 | A | 11/1986 | Kimble | |
| 5,332,117 | A | 7/1994 | Yadegar | |
| 5,540,354 | A | 7/1996 | Annand | |
| 5,695,091 | A | 12/1997 | Winnings | |
| 5,727,579 | A | 3/1998 | Chardack | |
| 5,972,126 | A * | 10/1999 | Fernie | E03C 1/14 134/29 |
| 7,222,747 | B1 | 5/2007 | Savran | |
| 7,659,824 | B2 | 12/2010 | Prodanovich | |
| 8,991,647 | B2 * | 3/2015 | Meyers | A61L 2/22 239/289 |
| 9,826,867 | B2 | 4/2017 | Krause | |
| 9,884,336 | B2 * | 2/2018 | Hoefte | B05B 11/3052 |

(Continued)

FOREIGN PATENT DOCUMENTS

| | | |
|---|---|---|
| CN | 209032089 | 6/2019 |
| DE | 10 2009 021 653 | 11/2010 |

(Continued)

*Primary Examiner* — Lien M Ngo
(74) *Attorney, Agent, or Firm* — Richard Malagiere, Esq.

(57) ABSTRACT

Disclosed embodiments provide a unique touchless combination device that provides simultaneous convenient use of three features, such as dispensing of liquid sanitizer, access to paper tissues, and a compartment for immediate and safe disposal of used tissues. Touchless operation is provided by use of several proximity sensors which allow to access and use all features of the device without need to touch any part of it. Disclosed embodiments also utilize UV LED lights for the purpose of disinfecting used and disposed tissues.

20 Claims, 7 Drawing Sheets

(56) References Cited

U.S. PATENT DOCUMENTS

| | | | | |
|---|---|---|---|---|
| 11,027,909 | B2 * | 6/2021 | Casper | B01F 35/881 |
| 2001/0006206 | A1 * | 7/2001 | Helfer-Grand | A47K 10/485 242/598.6 |
| 2002/0175182 | A1 | 11/2002 | Matthews | |
| 2003/0197026 | A1 | 10/2003 | Ashe | |
| 2005/0139719 | A1 | 6/2005 | Grebonval | |
| 2006/0289558 | A1 | 12/2006 | Parker | |
| 2007/0216267 | A1 | 9/2007 | Johanning | |
| 2009/0077736 | A1 * | 3/2009 | Loberger | E03C 1/01 4/619 |
| 2009/0090737 | A1 * | 4/2009 | Franco | A47K 5/12 221/96 |
| 2010/0187251 | A1 | 7/2010 | Simmons | |
| 2011/0018412 | A1 | 1/2011 | Swanek | |
| 2012/0218106 | A1 | 8/2012 | Zaima | |
| 2012/0313006 | A1 | 12/2012 | Chiu | |
| 2013/0105507 | A1 * | 5/2013 | Frias | A47K 10/42 221/45 |
| 2020/0193798 | A1 * | 6/2020 | Lindstrom | G09B 19/003 |
| 2021/0076883 | A1 * | 3/2021 | Nakao | B05B 11/3052 |
| 2022/0030404 | A1 * | 1/2022 | Nordin | G06V 20/52 |

FOREIGN PATENT DOCUMENTS

| | | |
|---|---|---|
| DE | 20 2020 000 617 | 4/2020 |
| DE | 20 2020 101 738 | 7/2020 |
| WO | WO 2018/193407 | 10/2018 |

* cited by examiner

TOUCHLESS SANITIZER COMBINATION DEVICE

CROSS-REFERENCE TO RELATED APPLICATIONS

The present disclosure claims priority to U.S. provisional patent application Ser. No. 63/101,877, filed May 20, 2020. The entire disclosure of application 63/101,877 is incorporated herein by reference.

FIELD

The present invention relates generally to personal product dispensing devices.

BACKGROUND

The present invention is in the field of sanitizing devices providing means for protecting user from bacterial contamination. More particularly, the present invention is a fully touchless wall-mounted, stand alone or desktop device that provides users' access to liquid sanitizer dispenser, dry or wet paper tissue dispenser and disposal compartment for storing used paper tissues.

There are numerous products and devices on a market which offer dispensing of sanitizing liquids and gels, as well as devices dispensing paper tissue and means of disposal of used tissues. Many of them require a user to touch parts of a device to use it. Touching parts of such products may reduce effectiveness of protection against bacterial contamination. It is therefore desirable to have improvements in sanitation devices.

SUMMARY

Disclosed embodiments provide a unique touchless combination device that provides simultaneous convenient use of three features, such as dispensing of liquid sanitizer, access to paper tissues, and a compartment for immediate and safe disposal of used tissues. Touchless operation is provided by use of several proximity (and/or motion) sensors which allow to access and use all features of the device without need to touch any part of it. Disclosed embodiments may also utilize ultraviolet (UV) light-emitting diode (LED) lights for the purpose of disinfecting used and disposed tissues.

In one embodiment, there is provided an apparatus, comprising: an enclosure; a processor, a memory coupled to the processor, a sanitizer dispenser; a pump, the pump coupled to the sanitizer dispenser, a sensor array, comprising a first proximity sensor, a second proximity sensor, and a third proximity sensor, a tissue compartment disposed within the enclosure, the tissue compartment comprising a tissue lid; a waste compartment disposed within the enclosure, the waste compartment comprising a waste lid; and wherein the memory comprises instructions, that when executed by the processor, cause the pump to operate to dispense sanitizer from the sanitizer dispenser in response to detecting motion by the first proximity sensor.

In another embodiment, there is provided an apparatus, comprising: an enclosure; a processor, a memory coupled to the processor, a sanitizer dispenser, a pump, the pump coupled to the sanitizer dispenser; a sensor array, comprising a first proximity sensor, a second proximity sensor, and a third proximity sensor, an AC (alternating current) power input port; a rechargeable battery coupled to the power input port; a switchover circuit configured and disposed to switch to battery power upon detecting a loss of AC power, a tissue compartment disposed within the enclosure, the tissue compartment comprising a tissue lid; a waste compartment disposed within the enclosure, the waste compartment comprising a waste lid; and wherein the memory comprises instructions, that when executed by the processor, cause the pump to operate to dispense sanitizer from the sanitizer dispenser in response to detecting motion by the first proximity sensor.

In yet another embodiment, there is provided an apparatus, comprising: an enclosure; a processor, a memory coupled to the processor; a sanitizer dispenser; a pump, the pump coupled to the sanitizer dispenser; a sensor array, comprising a first proximity sensor, a second proximity sensor, and a third proximity sensor, a tissue compartment disposed within the enclosure, the tissue compartment comprising a tissue lid; a waste compartment disposed within the enclosure, the waste compartment comprising a waste lid; a plurality of ultraviolet (UV) lights disposed on an inside surface of the waste lid; and wherein the memory comprises instructions, that when executed by the processor, cause the apparatus to: operate the pump to dispense sanitizer from the sanitizer dispenser in response to detecting motion by the first proximity sensor, cause the tissue lid actuator to open the tissue lid in response to detecting motion by the second proximity sensor, cause the tissue lid actuator to close the tissue lid in response to detecting an absence of motion for a predetermined duration by the second proximity sensor, cause the waste lid actuator to open the waste lid in response to detecting motion by the third proximity sensor; cause the waste lid actuator to close the waste lid in response to detecting an absence of motion for a predetermined duration by the third proximity sensor; and activate the plurality of ultraviolet (UV) lights in response to the closing of the waste lid.

BRIEF DESCRIPTION OF THE DRAWINGS

The structure, operation, and advantages of disclosed embodiments will become further apparent upon consideration of the following description taken in conjunction with the accompanying figures (FIGS.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity. Furthermore, for clarity, some reference numbers may be omitted in certain drawings.

DETAILED DESCRIPTION

Disclosed embodiments provide a unique touchless combination device that provides simultaneous convenient use of three features, such as dispensing of liquid sanitizer, access to paper tissues, and a compartment for immediate and safe disposal of used tissues. Touchless operation is provided by use of several proximity sensors which allow to access and use all features of the device without need to touch any part of it. Disclosed embodiments also utilize UV LED lights for the purpose of disinfecting used and disposed tissues.

Figure 1:
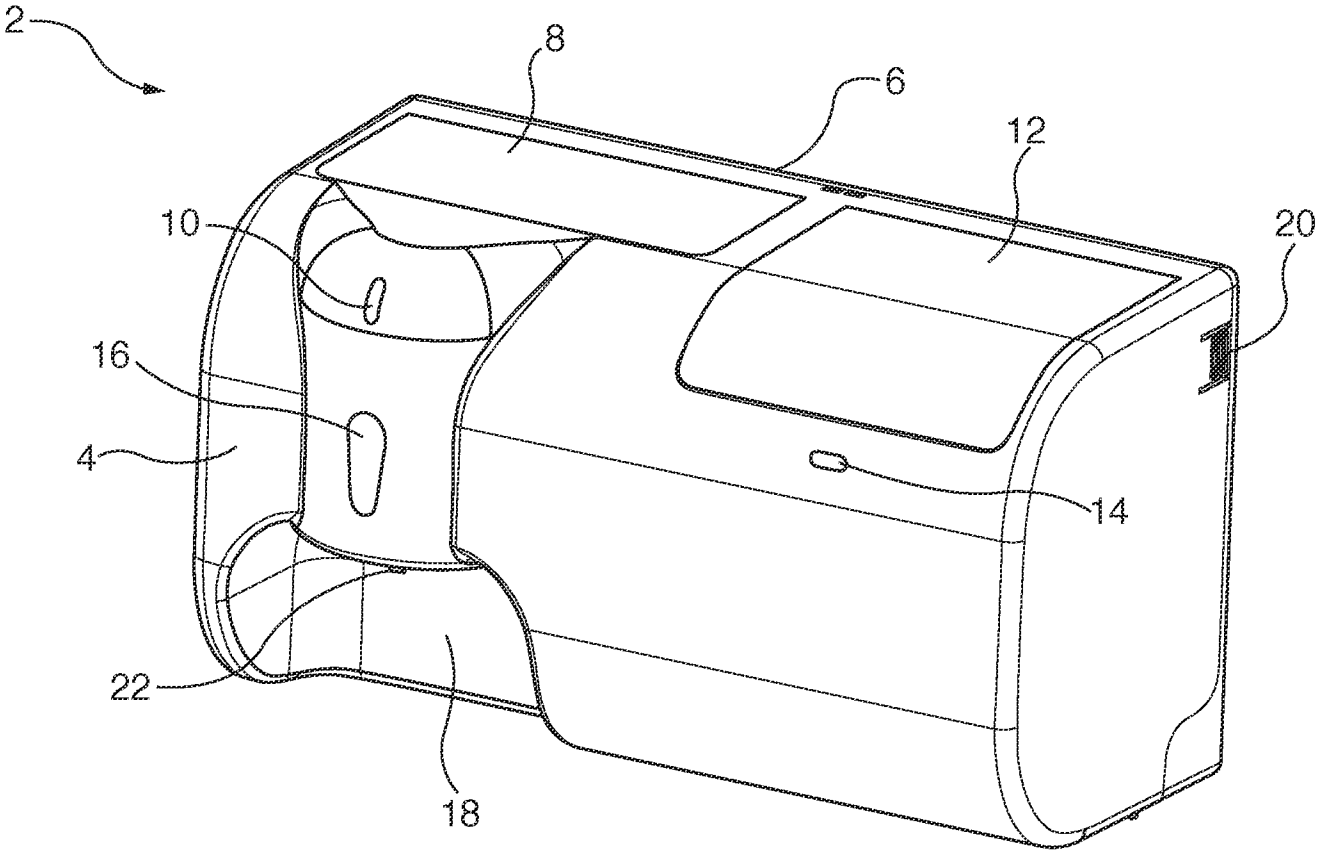
FIG. 1 is a front isometric view of a sanitizing device in accordance with disclosed embodiments.

Referring now to embodiments in more detail, in FIG. 1 there is shown sanitizing device 2 comprising front panel 4 and rear panel 6 with paper tissue door 8 and disposal compartment door (waste lid) 12; paper tissue door activation proximity sensor 10; disposal door activation proximity sensor 14; locking snaps 20; transparent sanitizer levels viewing plate 16; hand sanitizing cavity 18 and "no-drip" dispensing rubber duckbill valve 22.

Figure 2:
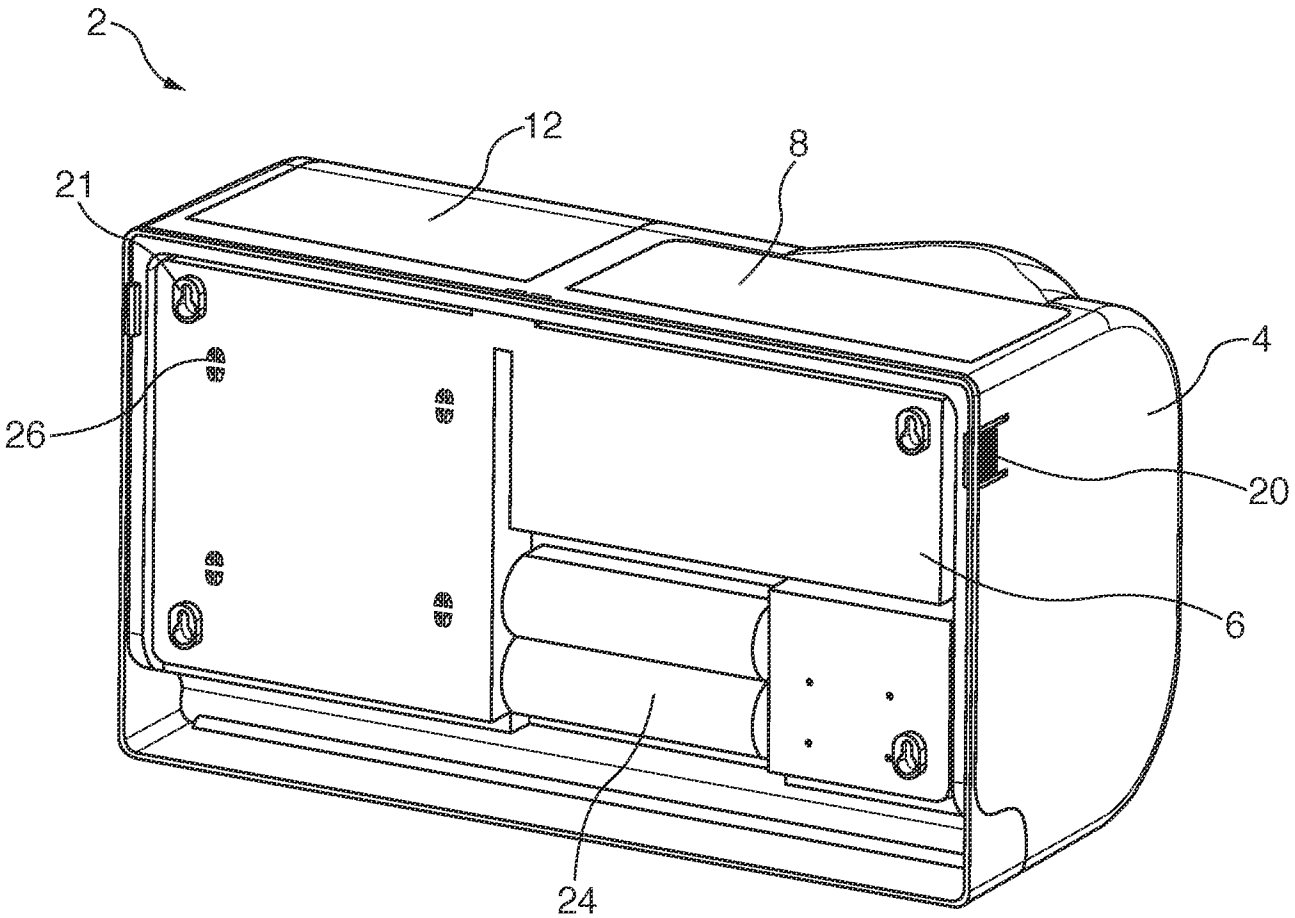
FIG. 2 is a rear isometric view of a sanitizing device in accordance with disclosed embodiments.

Now referring FIG. 2, sanitizing device 2 is shown in the rear isometric view with rear panel 6, front panel 4 having locking tabs 20; paper tissue door 8 and disposal door 12 as well as battery compartment 24 and wall hanging openings 21 and molded disposal frame hanging features, indicated generally as 26. The front panel 4 and rear panel 6 couple to each other to form an enclosure which houses the various components of disclosed embodiments.

Figure 3:
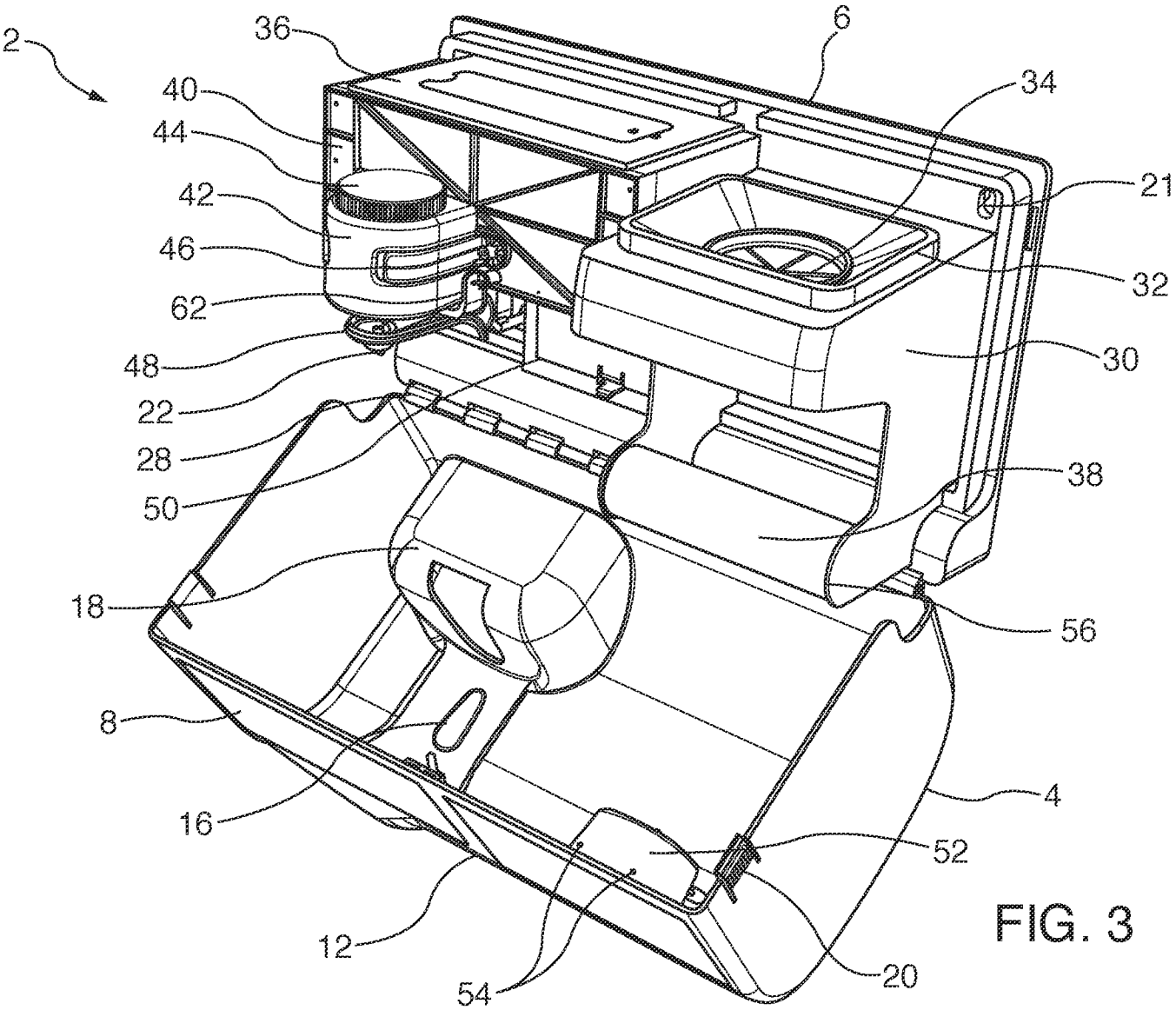
FIG. 3 is a front isometric view of an embodiment with its front panel open in accordance with disclosed embodiments.

Now referring to FIG. 3, the sanitizing device 2 is shown with front panel 4 open displaying inner setup of the device 2 with rear panel 6, that holds molded partition 40, which houses tissue compartment 36. In embodiments, the tissue compartment 36 is a standard paper tissue box of Kleenex type. Sanitizing device 2 also comprises liquid sanitizer container 42 retained by holding frame 46, attached with screws to the partition 40; liquid bottle having top cap 44 and assembly of nozzle holding frame 48 and frame 62 where frame 62 is also attached to partition 40 with screws. Holding frame 48 securely holds "no-drip" dispensing rubber duckbill valve 22. Rear panel 6 also features battery compartment 50. In embodiments, the battery compartment holds four cells of type "D" for powering all functions of sanitizing device 2 of disclosed embodiments. Other embodiments may utilize other battery types, including, but not limited to, rechargeable batteries. Other embodiments may utilize AC power from a power grid for power. In some embodiments, the sanitizing device may utilize AC power as a primary power source, with the batteries in battery compartment 50 serving as a backup to allow operation during a power outage. In those embodiments, the device may include a switchover circuit that can perform a switchover from AC power to battery power upon detecting a loss of AC power. Thus, embodiments can include a switchover circuit configured and disposed to switch to battery power upon detecting a loss of AC power.

In embodiments that utilize the batteries in battery compartment 50 as a backup power source, the sanitizing device may enter a power-saving mode of operation while being powered from the batteries. In embodiments, the power-saving mode may include slowing the clock speed of the on-board processor in order to conserve power.

Also shown in FIG. 3 is a disposal compartment (waste compartment) 30 having top bags retaining bracket 32 featuring rubber flaps membrane 34 that is configured and disposed to hold a plastic bag from disposal bags roll 38. Front panel 4 is attached in a pivoting manner to the rear panel 6 with system of hinges 28. Front panel 4 is also shown with locking snaps 20 on both sides of front panel 4; hand sanitizing cavity 18; liquid sanitizer level viewing window 16; paper tissue access door 8 and disposal door 12 with pusher 52 featuring UV LED lights 54. Thus, embodiments can include a plurality of ultraviolet (UV) lights disposed on an inside surface of the waste lid.

Figure 4:
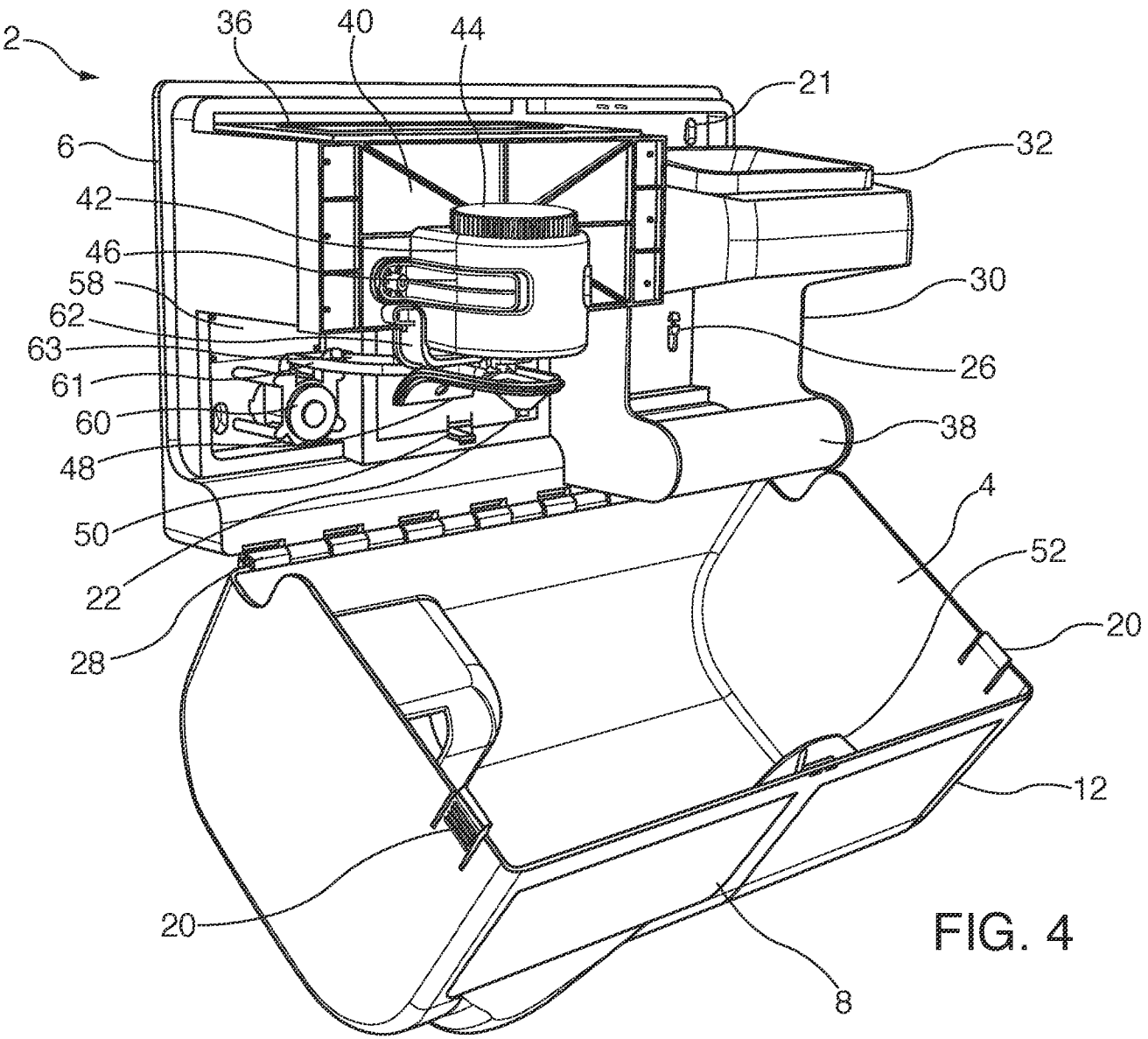
FIG. 4 is an additional isometric view of a sanitizing device of disclosed embodiments with its front panel open.

Now referring to FIG. 4, there is shown sanitizing device 2 in additional frontal isometric view with front panel 4; rear panel 6 with tissue compartment 36, held in place by molded partition 40. FIG. 4 also shows liquid pump 60 attached to rear panel 6 with liquid flexible tube 61 and liquid flexible tube 63 connecting pump 60 with dispensing valve 22 held by arrangement of frames 48 and frame 62. FIG. 4 also shows holding bracket 46 holding liquid sanitizer container 42 with top refill cap 44. Shown is also rear panel 6 with battery compartment 50; disposal compartment 30 attached to rear panel 6 via molded hanging features 26 and having top bag holding bracket 32 and disposal bags roll 38. The pump 60, container 42, and dispensing valve 22, comprise a sanitizer dispenser.

Figure 5:
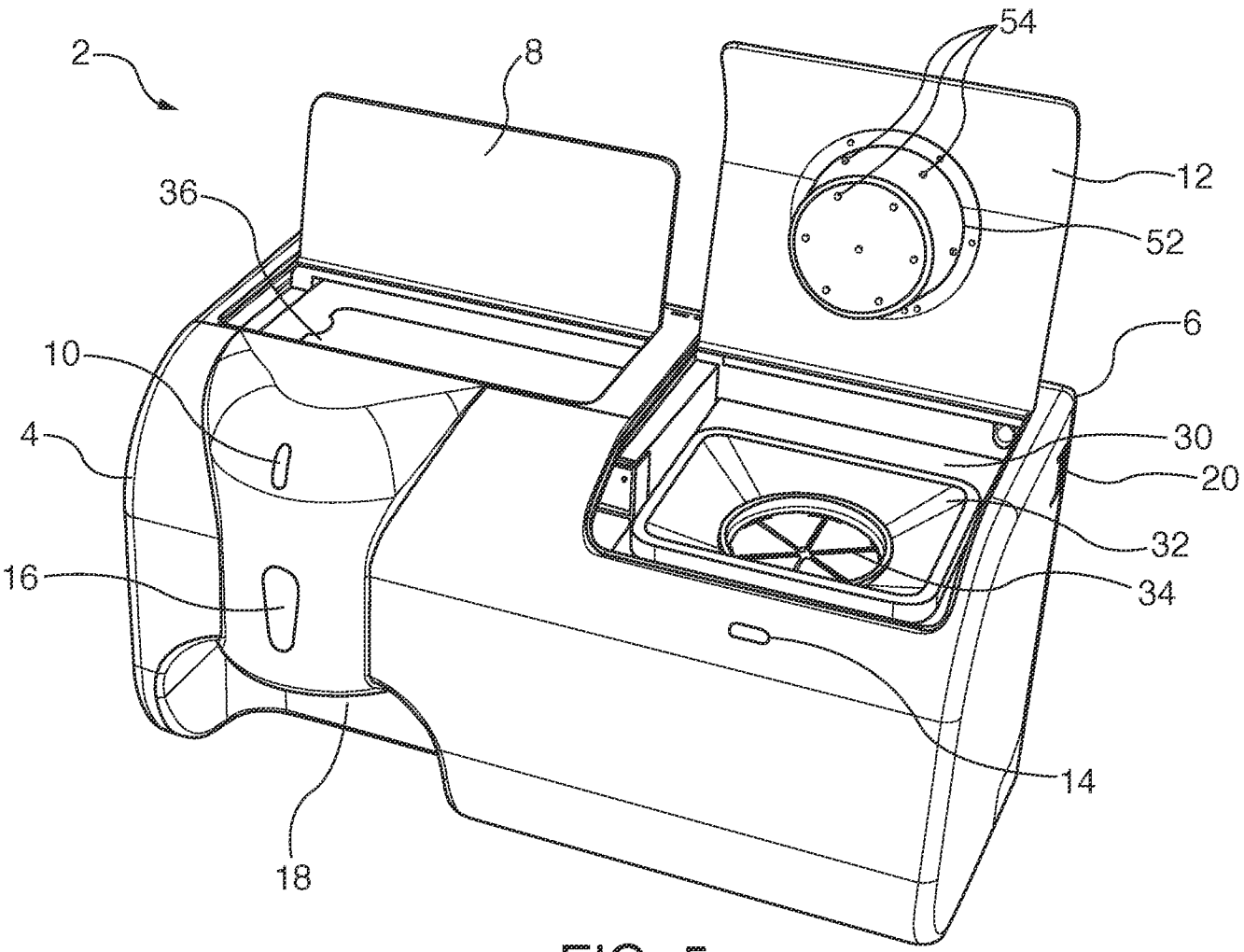
FIG. 5 is a front isometric view of a sanitizing device of disclosed embodiments with its doors open for access of fresh paper tissues and for disposal of used tissues in accordance with disclosed embodiments.

Referring now to FIG. 5, shown is the sanitizing device 2 of disclosed embodiments with paper tissue door 8 open allowing access to paper tissue compartment 36 and disposal compartment door 12 open giving access to disposal compartment 30 with disposal bags retaining bracket 32 that has rubber membrane 34. During use, a user may open paper tissue door 8 by waiving hand in front of corresponding proximity sensor 10 and then gains access to paper tissue compartment 36. Then user gains access to the disposal compartment (waste compartment) by waving a hand in front of disposal proximity sensor 14 which activates opening of disposal compartment door 12. Used paper tissues are deposited on rubber membrane 34 and after a preset time period disposal door 12 automatically closes, thereby pushing used tissue through membrane 34 into disposal bag with pusher 52, that can include a plurality UV LED lights 54 which irradiate disposed tissue and disposal opening area with UV light killing bacteria. In embodiments, the UV LED lights 54 may illuminate for a predetermined duration upon the closing of the disposal door 12. Thus, embodiments can include UV LED lights that are configured and disposed to illuminate an interior of the waste compartment for a predetermined duration in response to the closing of the waste lid. In some embodiments, the predetermined duration ranges from eight seconds to 15 seconds.

Figure 6:
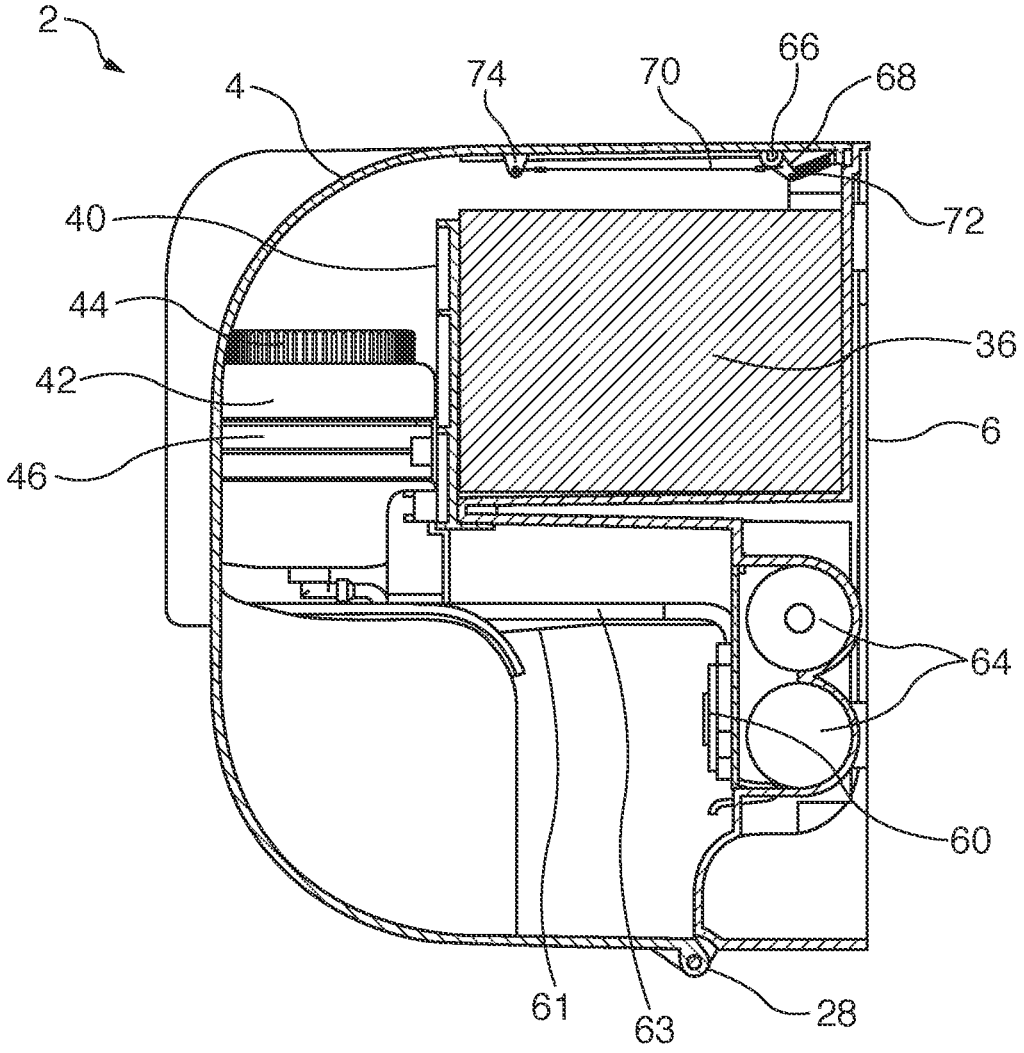
FIG. 6 is a side section view of a sanitizing device of disclosed embodiments.

Referring now to FIG. 6, there is shown a side section view of sanitizing device 2 of disclosed embodiments featuring Kleenex type standard paper tissue compartment 36, held in place by molded partition 40; also shown are "D" type battery cells powering the device. In embodiments, the battery compartment cavity is molded as integral part of rear panel 6. Front panel 4 is attached to rear panel 6 with hinges 28. Paper tissue retaining partition 40 is holding bracket 46, which is holding in place liquid sanitizer container 42. FIG. 6 shows a motor-less arrangement for opening paper tissue door 8 and disposal compartment door 12 using shape memory alloy actuator wire 70 with its frontal end attached to molded loop 74 and rear end attached to door hinge lever 68. In embodiments, the actuator wire 70 can serve as a tissue lid actuator and/or a waste lid actuator. When low DC electric power is applied to shape memory alloy actuator wire 70 it shrinks generating at least 4 pounds of force and pulling hinge lever 68, that opens paper tissue door 8 or disposal compartment door 12. After a predetermined time, electric DC power to the shape memory alloy actuator wire is cut off by control module 58 (FIG. 4) and shape memory alloy actuator wire 70 relaxes and extends its length allowing bias spring 72 to pull lever 68 back to closed doors position. In embodiments, the shape memory alloy actuator wire may be a FLEXINOL actuator wire sold by DYNALLOY, INC of Irvine Calif., USA.

Figure 7:
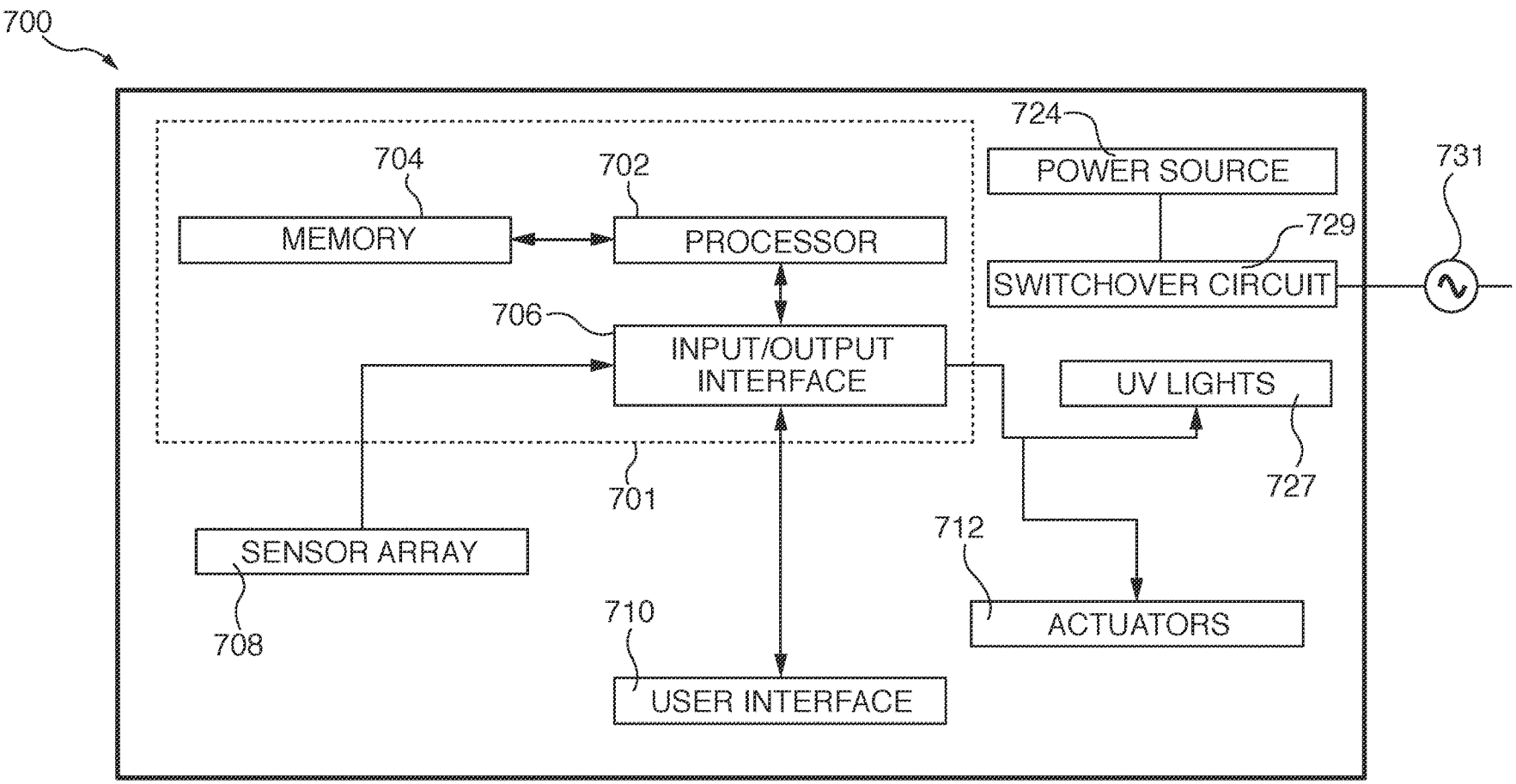
FIG. 7 is a block diagram of components of disclosed embodiments.

FIG. 7 is a block diagram of components of disclosed embodiments. Device 700 includes a processor 702, which is coupled to memory 704. The memory 704 contains instructions, that when executed by processor 702, perform steps in accordance with disclosed embodiments. Memory 704 may include a non-transitory computer-readable medium such as dynamic random-access memory (DRAM), static random-access memory (SRAM), magnetic storage, and/or a read only memory such as flash, EEPROM, optical storage, or other suitable memory. The processor 702 is coupled to input/output (I/O) interface 706. I/O interface 706 may include one or more GPIO (General Purpose I/O) pins that can be configured as inputs, outputs, or bidirectional pins. In embodiments, the processor 702, memory 704, and I/O interface 706 may be contained within a single integrated circuit 701 which may serve as control module 58 (FIG. 4).

Sensory array 708 may include one or more proximity sensors. The sensors can include passive infrared sensors, ultrasound sensors, or other suitable proximity sensors. Some sensors in the sensor array 708 may be used to detect the presence of a hand of a user to cause dispensing of product and/or opening of lids for tissue dispensing and/or waste disposal. Sensor array 708 may also include level sensors for dispensed product such as soap (sanitizer), wipes/towels, and or other dispensed products. Thus, sensor array 708 may include a sensor configured and disposed to detect a sanitizer empty condition, and may further include a sensor configured and disposed to detect a tissue supply depleted condition. Sensor array 708 may further include a lid sensor for the waste compartment that indicates when the waste lid is completely closed. In embodiments, the UV lights are activated only when the waste lid is completely closed.

User interface 710 may include one or more LEDs. Thus, in embodiments, user interface 710 includes an LED user interface. In embodiments, a multicolor LED may be used, that is capable of illuminating in green, yellow, and/or red. In other embodiments, individual LEDs of various colors may be used. In some embodiments, the user interface 710 includes a red LED. In embodiments, when the device is functioning properly and sufficiently busy, then the LED may illuminate green. When levels of product such as soap are below a predetermined level, then the LED may illuminate yellow, indicating a need for upcoming service/replenishment. If a product is depleted, the LED may illuminate red, indicating immediate service/replenishment is needed. Other embodiments may include a liquid crystal display (LCD) or other suitable user interface for conveying status information.

Actuators 712 may include motors, solenoids, shape memory alloy actuator wires, and/or other suitable mechanisms to open and close the waste compartment lid and/or tissue compartment lids during operation of the apparatus. Thus, embodiments can include a waste lid actuator and a tissue lid actuator. In embodiments, the actuators 712 are controlled by the processor 702 such that, in response to a sensor activation from sensor array 708, the processor 702 asserts signals on I/O interface 706 which cause the corresponding actuators 712 to operate. For example, when a sensor corresponding to a tissue lid is activated, the processor 702 activates the actuator corresponding to the tissue lid. After a predetermined period of inactivity (e.g. three to six seconds), the processor 702 may activate the actuator to close the tissue lid. Thus, in embodiments, the processor 702 executes instructions to cause the tissue lid actuator to close the tissue lid in response to detecting an absence of motion for a predetermined duration by the second proximity sensor.

UV lights 727 may be configured and disposed to illuminate the contents of the waste compartment for a predetermined period of time upon detecting the closing of the waste lid. As an example, the processor 702 may receive a signal via I/O interface 706 from sensor array 708 and in response, activate a corresponding actuator 712 to open the waste lid. After a predetermined period of inactivity from the sensor, the processor 702 activates the corresponding actuator to close the waste lid. Upon detecting the closing of the waste lid (through a waste lid position sensor), the processor 702 then activates UV lights 727 for a predetermined duration (e.g., 15 to 30 seconds). This activation of the UV lights 727 serves to disinfect used tissues in the waste compartment, thereby reducing the risk of spread of disease and illnesses.

Embodiments include power source 724 which may include a rechargeable battery. In embodiments, the rechargeable battery may be a lithium-ion battery, nickel cadmium battery, or other suitable battery type. Some embodiments may receive primary power from an AC power source 731. Embodiments may include a switchover circuit 729 that switches to the battery power of power source 724 in response to a loss of AC power from AC power source 731. In embodiments, a relay may be used in the switchover circuit 729, such that when the AC power source 731 is lost, the relay, upon losing power, switches to an input connected to the rechargeable battery power source 724.

Other embodiments may utilize non-rechargeable batteries in power source 724, and not utilize AC power. In some embodiments, a plurality of batteries, such as D cells or C cells may be configured in parallel or series within the power source 724 to obtain the necessary power for operation of sensors, actuators, pumps, and other components of the touchless sanitizer combination device.

The advantages of disclosed embodiments include, without limitation, a combination device that provides easy and fully touchless access to several features such as paper tissues, touchless activation of liquid sanitizer dispensing and touchless access to disposal compartment.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiments, methods, and examples, but by all embodiments and methods within the scope and spirit of the invention as described.

What is claimed is:

1. A touchless sanitizing apparatus, comprising:

an enclosure;

a processor;

a memory coupled to the processor;

a sanitizer dispenser;

a pump, the pump coupled to the sanitizer dispenser;

a sensor array, comprising a first proximity sensor, a second proximity sensor, and a third proximity sensor;

a tissue compartment disposed within the enclosure, the tissue compartment comprising a tissue lid;

a waste compartment disposed within the enclosure, the waste compartment comprising a waste lid; and wherein the memory comprises instructions, that when executed by the processor, cause the pump to operate to dispense sanitizer from the sanitizer dispenser in response to detecting motion by the first proximity sensor.

2. The apparatus of claim 1, further comprising:

a tissue lid actuator; and wherein the memory further comprises instructions, that when executed by the processor, cause the tissue lid actuator to open the tissue lid in response to detecting motion by the second proximity sensor.

3. The apparatus of claim 2, wherein the memory further comprises instructions, that when executed by the processor, cause the tissue lid actuator to close the tissue lid in response to detecting an absence of motion for a predetermined duration by the second proximity sensor.

4. The apparatus of claim 3, wherein the predetermined duration ranges from 3 seconds to 6 seconds.

5. The apparatus of claim 1, further comprising:

a waste lid actuator; and wherein the memory further comprises instructions, that when executed by the processor, cause the waste lid actuator to open the waste lid in response to detecting motion by the third proximity sensor.

6. The apparatus of claim 5, wherein the memory further comprises instructions, that when executed by the processor, cause the waste lid actuator to close the waste lid in response to detecting an absence of motion for a predetermined duration by the third proximity sensor.

7. The apparatus of claim 3, wherein the predetermined duration ranges from 3 seconds to 6 seconds.

8. The apparatus of claim 1, further comprising an LED user interface comprising a red LED, and wherein the memory further comprises instructions, that when executed by the processor, cause the red LED to illuminate upon detecting a sanitizer empty condition.

9. The apparatus of claim 1, further comprising an LED user interface comprising a red LED, and wherein the memory further comprises instructions, that when executed by the processor, cause the red LED to illuminate upon detecting a tissue supply depleted condition.

10. The apparatus of claim 6, further comprising a plurality of ultraviolet (UV) lights configured and disposed to illuminate an interior of the waste compartment in response to the closing of the waste lid.

11. A touchless sanitizing apparatus, comprising:

an enclosure;

a processor;

a memory coupled to the processor;

a sanitizer dispenser;

a pump, the pump coupled to the sanitizer dispenser;

a sensor array, comprising a first proximity sensor, a second proximity sensor, and a third proximity sensor;

an AC (alternating current) power input port;

a rechargeable battery coupled to the power input port;

a switchover circuit configured and disposed to switch to battery power upon detecting a loss of AC power;

a tissue compartment disposed within the enclosure, the tissue compartment comprising a tissue lid;

a waste compartment disposed within the enclosure, the waste compartment comprising a waste lid; and wherein the memory comprises instructions, that when executed by the processor, cause the pump to operate to dispense sanitizer from the sanitizer dispenser in response to detecting motion by the first proximity sensor.

12. The apparatus of claim 11, further comprising:

a tissue lid actuator; and wherein the memory further comprises instructions, that when executed by the processor, cause the tissue lid actuator to open the tissue lid in response to detecting motion by the second proximity sensor.

13. The apparatus of claim 12, wherein the memory further comprises instructions, that when executed by the processor, cause the tissue lid actuator to close the tissue lid in response to detecting an absence of motion for a predetermined duration by the second proximity sensor.

14. The apparatus of claim 13, wherein the predetermined duration ranges from 3 seconds to 6 seconds.

15. The apparatus of claim 11, further comprising:

a waste lid actuator; and wherein the memory further comprises instructions, that when executed by the processor, cause the waste lid actuator to open the waste lid in response to detecting motion by the third proximity sensor.

16. The apparatus of claim 15, wherein the memory further comprises instructions, that when executed by the processor, cause the waste lid actuator to close the waste lid in response to detecting an absence of motion for a predetermined duration by the third proximity sensor.

17. The apparatus of claim 13, wherein the predetermined duration ranges from 3 seconds to 6 seconds.

18. The apparatus of claim 11, further comprising an LED user interface comprising a red LED, and wherein the memory further comprises instructions, that when executed by the processor, cause the red LED to illuminate upon detecting a sanitizer empty condition.

19. The apparatus of claim 11, further comprising an LED user interface comprising a red LED, and wherein the memory further comprises instructions, that when executed by the processor, cause the red LED to illuminate upon detecting a tissue supply depleted condition.

20. A touchless sanitizing apparatus, comprising:

an enclosure;

a processor;

a memory coupled to the processor;

a sanitizer dispenser;

a pump, the pump coupled to the sanitizer dispenser;

a sensor array, comprising a first proximity sensor, a second proximity sensor, and a third proximity sensor;

a tissue compartment disposed within the enclosure, the tissue compartment comprising a tissue lid;

a waste compartment disposed within the enclosure, the waste compartment comprising a waste lid;

a plurality of ultraviolet (UV) lights disposed on an inside surface of the waste lid; and wherein the memory comprises instructions, that when executed by the processor, cause the apparatus to:

operate the pump to dispense sanitizer from the sanitizer dispenser in response to detecting motion by the first proximity sensor;

cause the tissue lid actuator to open the tissue lid in response to detecting motion by the second proximity sensor;

cause the tissue lid actuator to close the tissue lid in response to detecting an absence of motion for a predetermined duration by the second proximity sensor;

cause the waste lid actuator to open the waste lid in response to detecting motion by the third proximity sensor;

cause the waste lid actuator to close the waste lid in response to detecting an absence of motion for a predetermined duration by the third proximity sensor; and activate the plurality of ultraviolet (UV) lights in response to the closing of the waste lid.

* * * * *